US007993148B2

(12) United States Patent
Khemakhem et al.

(10) Patent No.: US 7,993,148 B2
(45) Date of Patent: Aug. 9, 2011

(54) HIGH DENSITY COAXIAL JACK

(75) Inventors: M'hamed Anis Khemakhem, Eden Prairie, MN (US); Cyle Petersen, Belle Plaine, MN (US)

(73) Assignee: ADC Telecommunications, Inc., Eden Prairie, MN (US)

( * ) Notice: Subject to any disclaimer, the term of this patent is extended or adjusted under 35 U.S.C. 154(b) by 0 days.

(21) Appl. No.: 12/817,751

(22) Filed: Jun. 17, 2010

(65) Prior Publication Data

US 2010/0255700 A1 Oct. 7, 2010

Related U.S. Application Data

(63) Continuation of application No. 12/341,586, filed on Dec. 22, 2008, now Pat. No. 7,744,392, which is a continuation of application No. 11/879,219, filed on Jul. 16, 2007, now Pat. No. 7,470,133, which is a continuation of application No. 11/408,613, filed on Apr. 21, 2006, now Pat. No. 7,244,131.

(51) Int. Cl.
*H01R 29/00* (2006.01)

(52) U.S. Cl. ..... 439/188

(58) Field of Classification Search ..... 439/188, 439/620, 944; 200/51.09
See application file for complete search history.

(56) References Cited

U.S. PATENT DOCUMENTS

| | | | |
|---|---|---|---|
| 3,020,365 | A | 2/1962 | Neenan |
| 3,873,785 | A | 3/1975 | Lieberman |
| 3,946,390 | A | 3/1976 | Alexander et al. |
| 4,264,115 | A | 4/1981 | Chow |
| 4,749,968 | A | 6/1988 | Burroughs |
| 4,815,104 | A | 3/1989 | Williams et al. |
| 4,820,200 | A | 4/1989 | Lau |
| 5,233,501 | A | 8/1993 | Allen et al. |
| 5,246,378 | A | 9/1993 | Seiceanu |
| 5,348,491 | A | 9/1994 | Louwagie et al. |
| 5,382,173 | A | 1/1995 | Brown et al. |
| 5,467,062 | A | 11/1995 | Burroughs |
| 5,482,469 | A | 1/1996 | Seiceanu et al. |
| 5,702,262 | A | 12/1997 | Brown et al. |
| 5,885,096 | A | 3/1999 | Ogren |
| 5,913,701 | A | 6/1999 | Olson et al. |
| 5,964,607 | A | 10/1999 | Finke et al. |
| 6,045,378 | A | 4/2000 | Follingstad |
| 6,504,726 | B1 | 1/2003 | Grabinger et al. |
| 6,511,330 | B1 | 1/2003 | Norris |
| 6,575,792 | B2 | 6/2003 | Henneberger et al. |
| 6,589,062 | B1 | 7/2003 | Ogren et al. |

(Continued)

FOREIGN PATENT DOCUMENTS

| | | | |
|---|---|---|---|
| EP | 0 561 238 | A | 9/1993 |

(Continued)

*Primary Examiner* — Phuong K Dinh
(74) *Attorney, Agent, or Firm* — Merchant & Gould P.C.

(57) ABSTRACT

A coaxial switching jack with a pair of coaxial assemblies mounted within a housing having a pair of front cable connection locations is disclosed. The coaxial assemblies each include a center conductor and an outer shield conductor. The center conductors are connected by a first spring and the shell conductors are connected by a second spring. Insertion of a coaxial cable connector within one of the front cable connection locations deflects the springs from the corresponding coaxial assembly and disconnects the center and shell conductors of the two assemblies. The jack may also be configured to provide an electrical connection between the center and shell conductors of the second coaxial assembly if a coaxial cable connector is inserted within the first coaxial assembly. The connection between the center and shell conductors of the second coaxial assembly may be through a resistor assembly allowing for selection of a desired electrical impedance.

10 Claims, 20 Drawing Sheets

U.S. PATENT DOCUMENTS

| | | | |
|---|---|---|---|
| 6,608,764 | B2 | 8/2003 | Clark et al. |
| 6,743,032 | B2 | 6/2004 | Ogren et al. |
| 6,817,876 | B2 | 11/2004 | Cooper et al. |
| 6,848,948 | B1 | 2/2005 | Khemakhem et al. |
| 6,881,099 | B2 | 4/2005 | Henneberger et al. |
| 6,953,368 | B2 | 10/2005 | Khemakhem et al. |
| 7,244,131 | B1 | 7/2007 | Khemakhem et al. |
| 7,470,133 | B2 | 12/2008 | Khemakhem et al. |
| 2006/0234538 | A1 | 10/2006 | Khemakhem et al. |

FOREIGN PATENT DOCUMENTS

| | | |
|---|---|---|
| EP | 0 706 723 B1 | 5/1998 |
| WO | WO 96/37929 | 11/1996 |

HIGH DENSITY COAXIAL JACK

CROSS-REFERENCE TO RELATED APPLICATIONS

This application is a continuation of application Ser. No. 12/341,586, filed Dec. 22, 2008, which is a continuation of application Ser. No. 11/879,219, filed Jul. 16, 2007, now U.S. Pat. No. 7,470,133, which is a continuation of application Ser. No. 11/408,613, filed Apr. 21, 2006, now U.S. Pat. No. 7,244,131, which applications are incorporated herein by reference in their entirety.

FIELD

The present invention relates generally to devices for making connections between telecommunication equipment. More specifically, the present invention relates to coaxial switching jack assemblies for connecting coaxial cables.

BACKGROUND

In a typical coaxial switching arrangement, a connection panel might be mounted in a studio, with a number of signal generating devices and a number signal processing devices. Coaxial cables might be used to transmit signal from signal generating devices to signal processing devices or between different signal processing devices. Flexibility in configuration of the connections between this equipment is desirable so that different signal generating or processing needs may be accommodated. Many of the devices may have signal in and signal out paths, so that each such device has a pair of coaxial cables extending from it to the connection panel. These pairs of cables are connected to a pair of openings of a switching jack. Multiple devices may be connected to the rear of the switching jacks. When connection is desired between different pieces of equipment connected to the panel, coaxial patch cables inserted in the front of the switching jacks are used. As configurations of equipment change, the connections between equipment may be adapted by rearranging the patch cables without disturbing the connection between the equipment and the panel.

Coaxial switching jacks permit signals carried by coaxial cables between different pieces of broadcast and telecommunications equipment to be configured and directed as needed. Similar switching jacks may be used for digital and analog audio signals, as well as for video signals. It is desirable to have switching jacks which may be used for any of these signals, as well as switching jacks that can selectively loop pairs of signals, connect a third cable to one of the pairs of signals while terminating the other signal, and connect to both signals of the pair to other cables.

SUMMARY

According to one aspect of the invention, the present disclosure relates to a coaxial switching jack with a pair of coaxial assemblies mounted within the jack housing. A resistor moveably mounted within the housing is moveable between an "ON" position and an "OFF" position without being removed from the housing. A switch selectively disconnects the center conductors and the outer shell conductors of the coaxial assemblies, wherein insertion of a mating coaxial cable connector into one of front cable connection location of jack removes the center conductor of the corresponding coaxial assembly from electrical contact with the center conductor of the other coaxial assembly and removes the outer shell conductor of the corresponding coaxial assembly from electrical contact with the outer shell conductor of the other coaxial assembly. Wherein once a coaxial cable connector is inserted, the outer shell conductor and the center conductor of the other coaxial assembly are electrically connected through the resistor when the resistor is in the "ON" position and the outer shell conductor and the center conductor of the other coaxial assembly are electrically isolated from each other when the resistor is in the "OFF" position.

According to another aspect of the invention, the present disclosure relates to a coaxial switching jack with a pair of coaxial assemblies mounted within the jack housing. A first conductive spring contacts a center conductor of each of the coaxial assemblies and a pair of second conductive springs electrically connect the outer shell conductors of the coaxial assemblies. Wherein insertion of a mating coaxial cable connector into one of cable connection locations deflects a first arm of the first spring away from electrical contact with the center conductor of the corresponding coaxial assembly such that the first arm contacts a first end of one of the second springs and deflects the first end of the corresponding second spring away from electrical contact with the outer shell conductor of the corresponding coaxial assembly and deflects the second end of the corresponding second spring away from contact with the second end of the other second spring, wherein the first end of the other second spring stays in contact with the outer shell conductor of the non-mated coaxial assembly.

According to yet another aspect of the invention, the present disclosure relates to a coaxial switching jack having a housing with a pair of coaxial assemblies mounted within the jack housing. Each coaxial assembly includes a center conductor and an outer shell conductor. The outer shell conductor includes a generally cylindrical wall and an opening formed in the cylindrical wall. A conductive spring contacting the center conductors of the coaxial assemblies is received through the opening to contact the center conductors, wherein the outer shell conductors are also electrically connected. Insertion of a coaxial cable connector into one of cable connection locations deflects the conductive spring away from electrical contact with the center conductor of the corresponding coaxial assembly and also electrically isolates the outer shell conductors of the coaxial assemblies, closing up the opening on the cylindrical wall of the outer shell conductor of the corresponding coaxial assembly to form a generally cylindrical conductive passage about the center conductors.

BRIEF DESCRIPTION OF THE DRAWINGS

The accompanying drawings, which are incorporated in and constitute a part of the specification, illustrate several aspects of the present invention and together with the description, serve to explain the principles of the invention. A brief description of the drawings is as follows.

DETAILED DESCRIPTION

Reference will now be made in detail to the exemplary aspects of the present invention that are illustrated in the accompanying drawings. Wherever possible, the same reference numbers will be used throughout the drawings to refer to the same or like parts.

Figure 1:
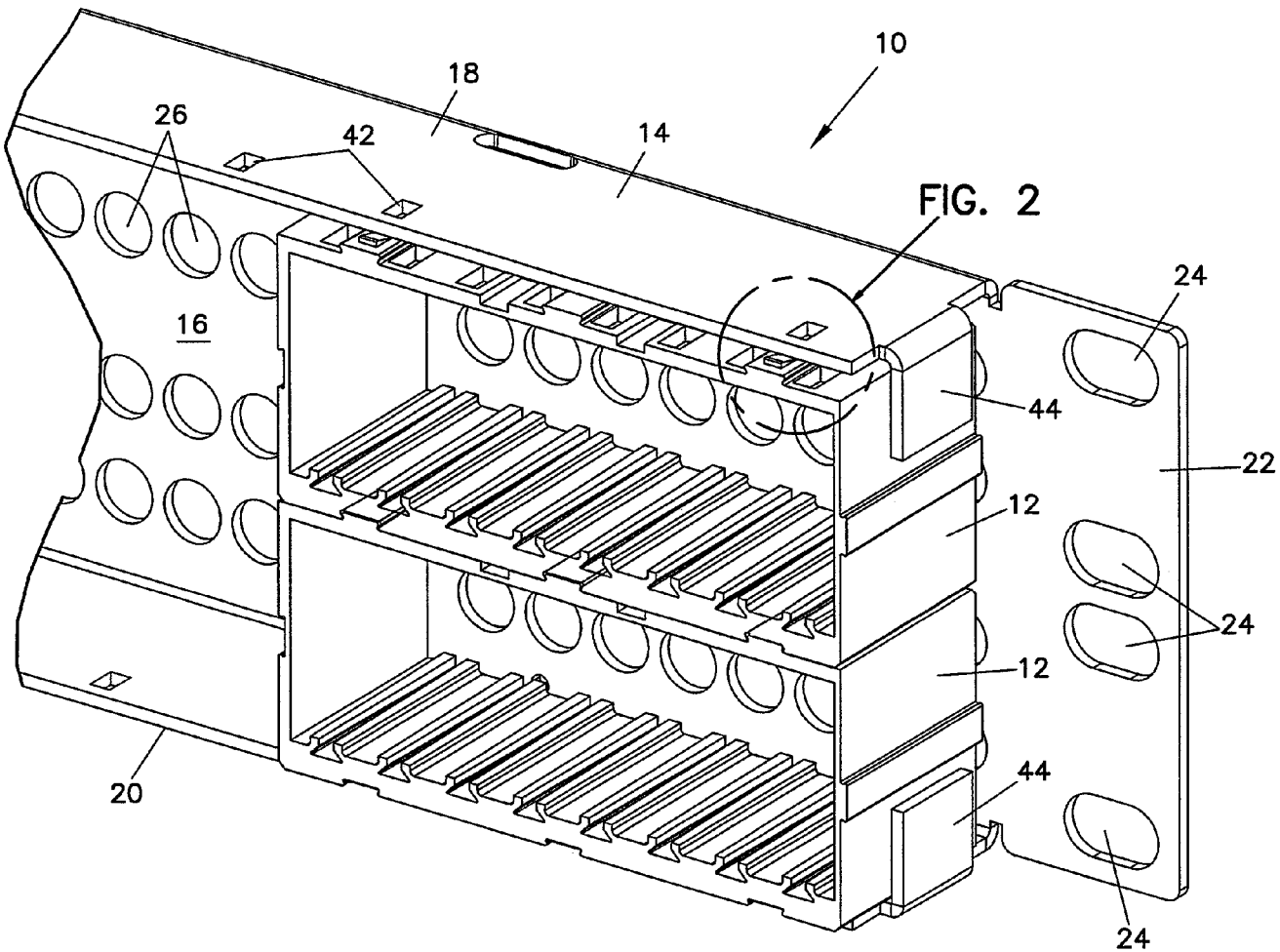
FIG. 1 is a partial rear perspective view of a telecommunications panel including a frame with a pair of jack mounting plates being mounted on the frame according to the present invention.
Figure 7:
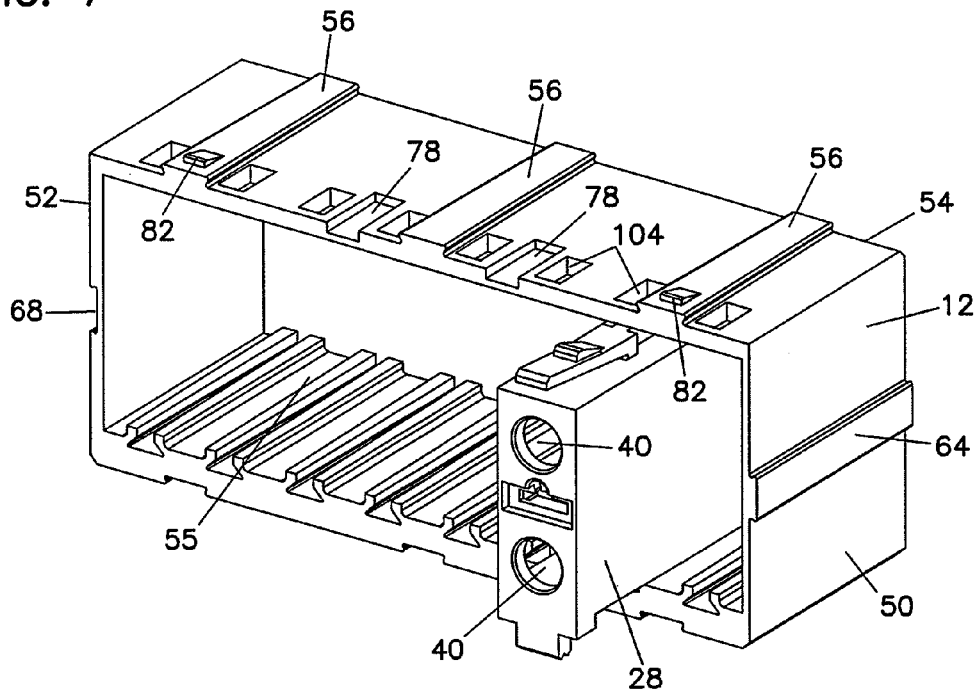
FIG. 7 is a top rear perspective view of a jack mounting plate shown with a coaxial switching jack being mounted thereon according to the invention.
Figure 8:
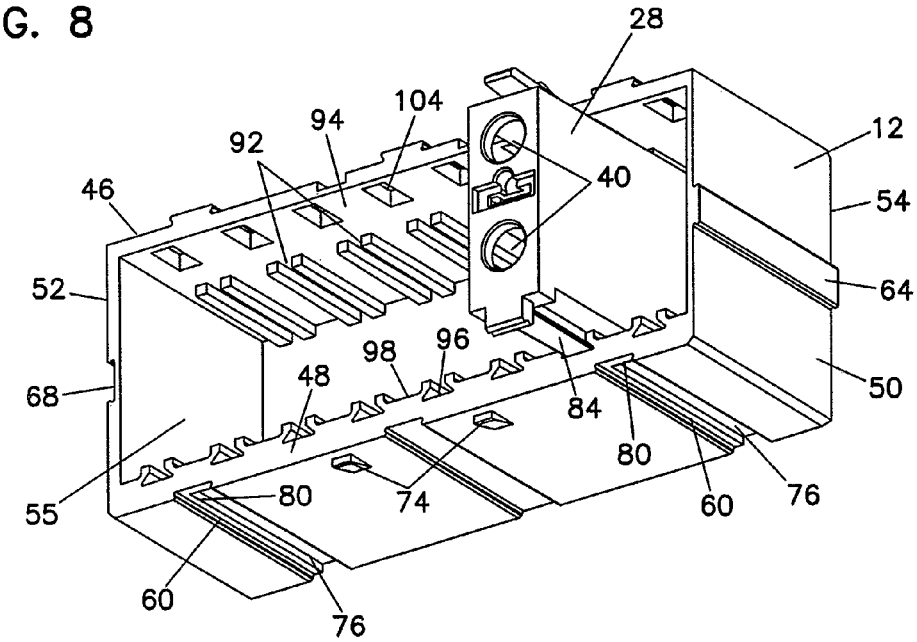
FIG. 8 is a bottom rear perspective view of the jack mounting plate and the coaxial switching jack of FIG. 7.
Figure 10:
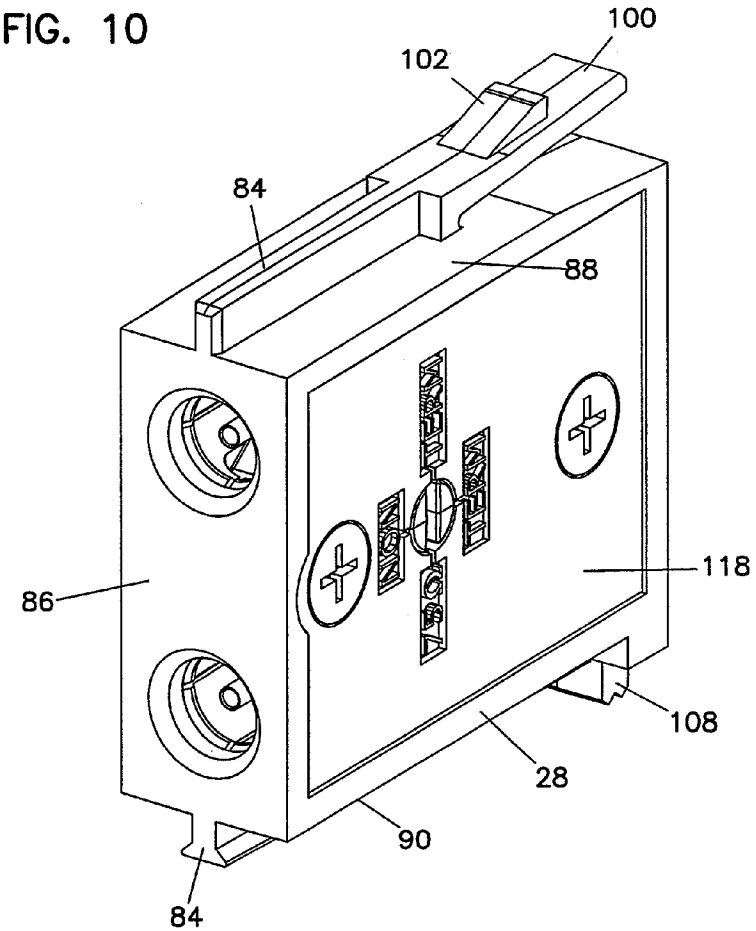
FIG. 10 is a front perspective view of the coaxial switching jack of FIG. 9.
Figure 9:
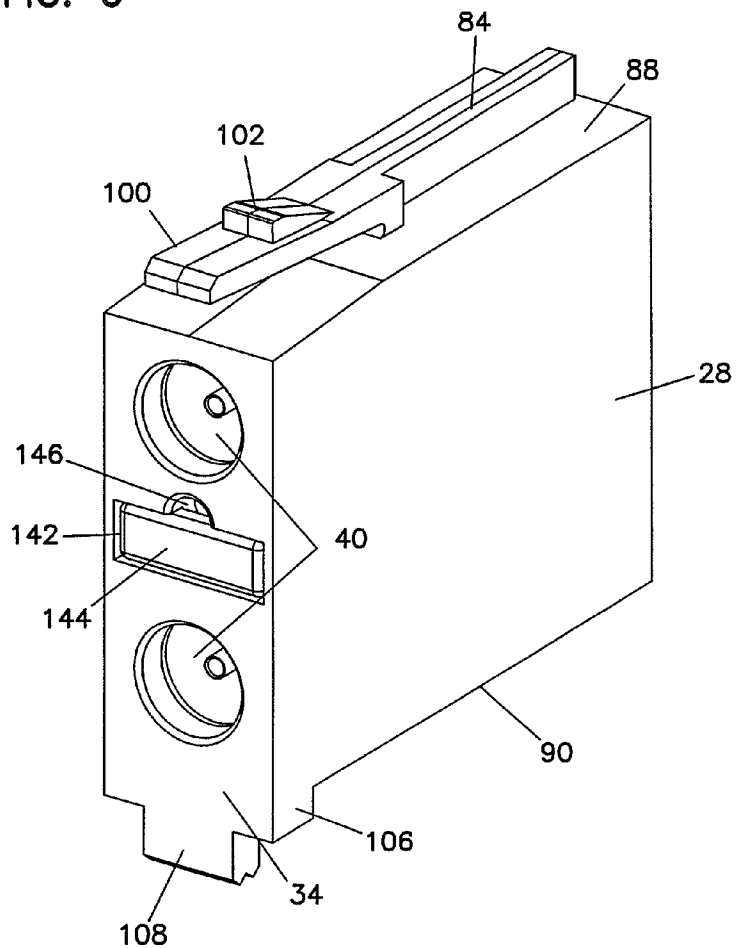
FIG. 9 is a rear perspective view of a coaxial switching jack according to the present invention.
Figure 12:
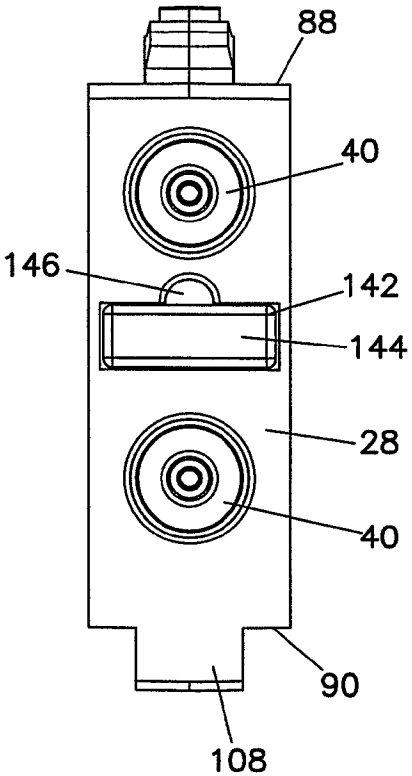
FIG. 12 is a rear elevational view of the coaxial switching jack of FIG. 9.
Figure 11:
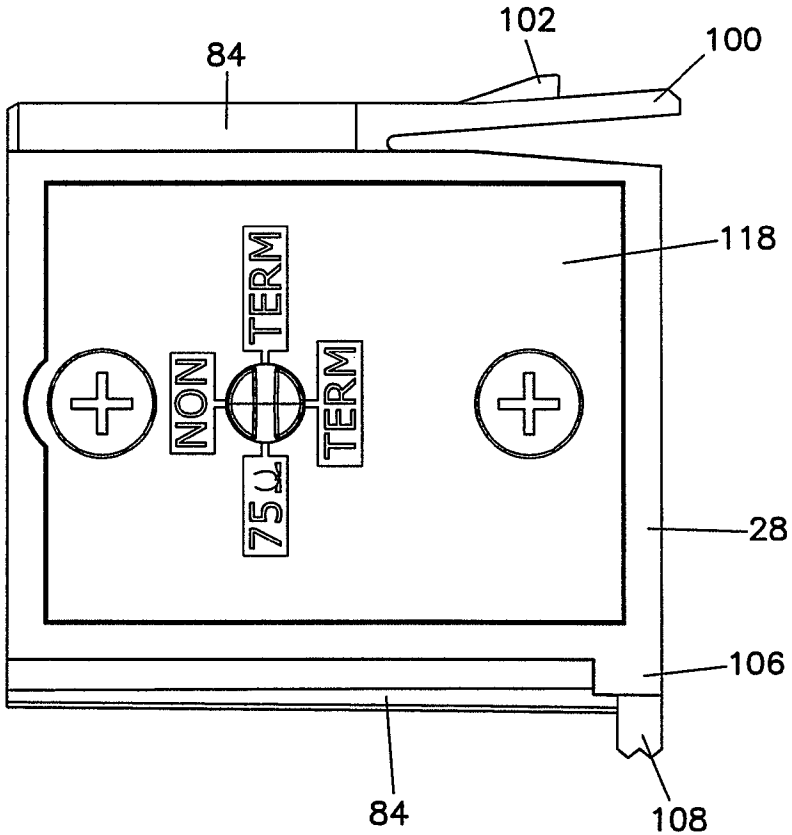
FIG. 11 is a right side elevational view of the coaxial switching jack of FIG. 9.
Figure 13:
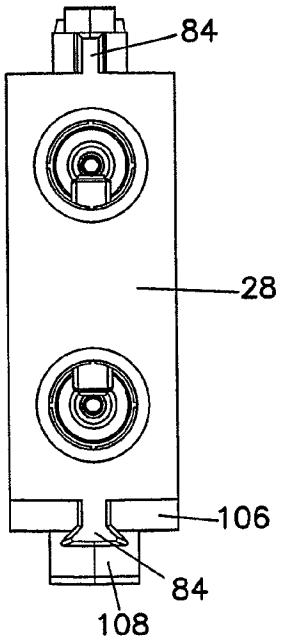
FIG. 13 is a front elevational view of the coaxial switching jack of FIG. 9.
Figure 14:
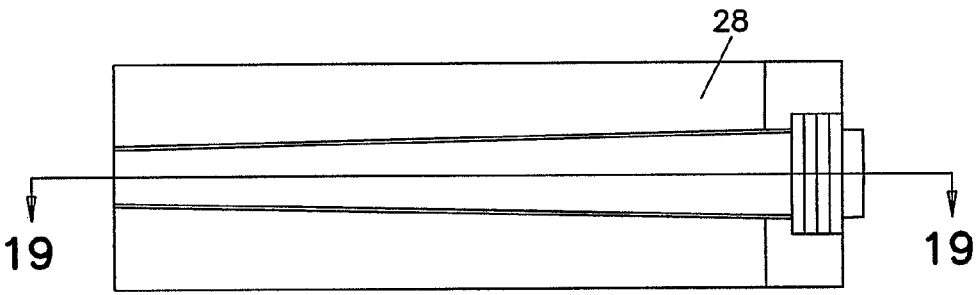
FIG. 14 is a bottom plan view of the coaxial switching jack of FIG. 9.

FIG. 1 shows a partial perspective view of a telecommunications panel 10 with a pair of mounting plates 12 and a frame 14 to which mounting plates 12 are mounted. Frame 14 includes a front wall 16 and top and bottom walls 18, 20 extending rearwardly from front wall 16. Frame 14 includes mounting flanges 22 on each end with fastener openings 24 located on the sides of front wall 16 for mounting panel 10 to another structure, such as an equipment rack. Front wall 16 of frame 14 defines a plurality of openings 26 permitting access to coaxial switching jacks 28 mounted to mounting plates 12, as shown in FIGS. 7 and 8. Each opening 26 permits access to one of the front cable connection locations 30 of coaxial switching jacks 28. Front cable connection locations 30 are configured as front openings 32 in the embodiment depicted in FIGS. 9-19. On a rear wall 34 of each switching jack 28 is a pair of rear cable connection locations 36 which are configured to accept coaxial cable connectors 38. Rear cable connection locations 36 are also configured as openings 40 in the embodiments depicted.

Top and bottom walls 18, 20 of frame 14 include openings 42 for interlocking mounting plates 12 to frame 14, as will be discussed in further detail below. Top and bottom walls 18, 20 also include opposing side flange portions 44 for guiding in and supporting mounting plates 12 with respect to frame 14.

Figure 5:
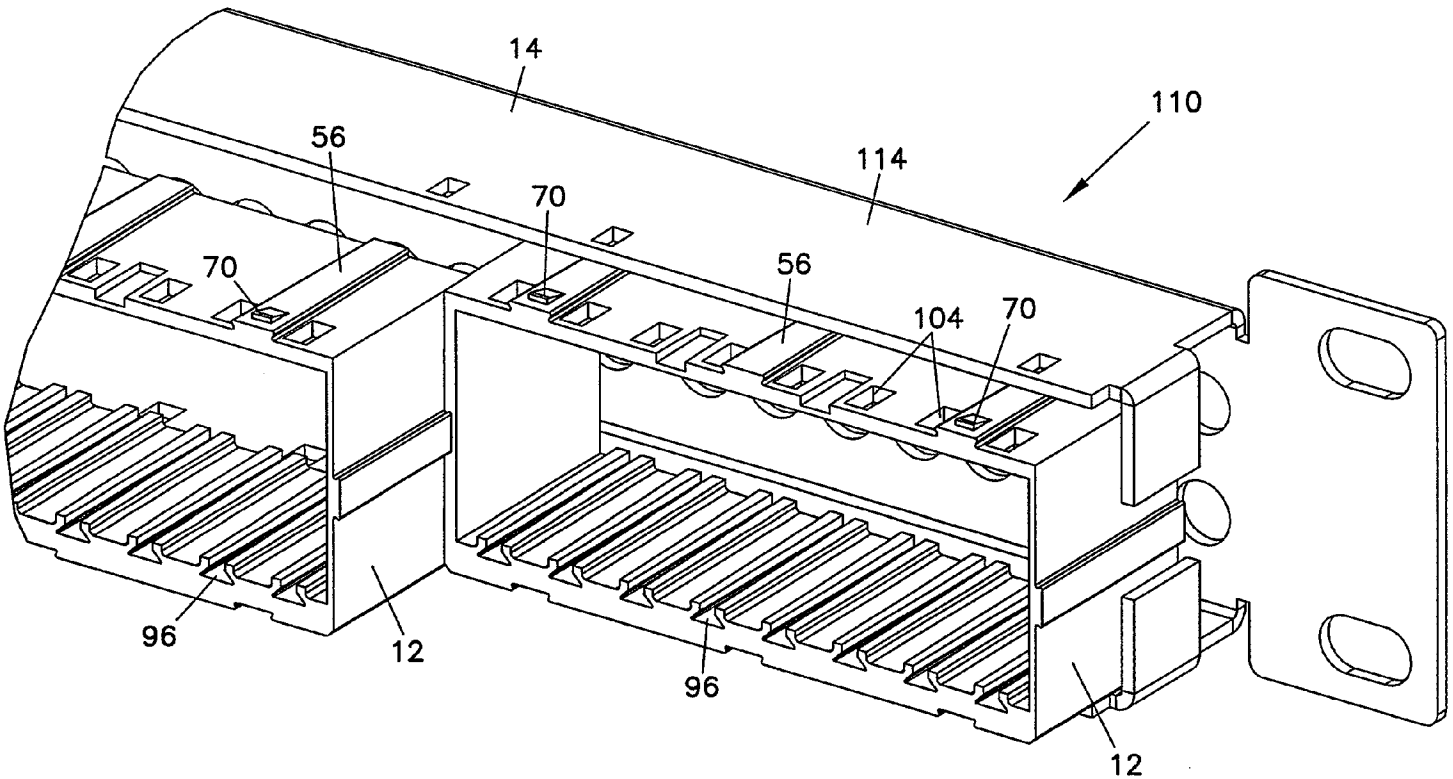
FIG. 5 is a partial rear perspective view of an alternative telecommunications panel including an alternative frame shown with a pair of jack mounting plates being mounted on the frame according to the present invention.

While FIG. 1 illustrates a panel with a frame which accommodates two rows of mounting plates 12, FIG. 5 illustrates an alternative panel 110 with a frame 114 configured to accommodates a single row of mounting plates 12. Panel 110 is similar is construction and function to panel 10.

Figure 2:
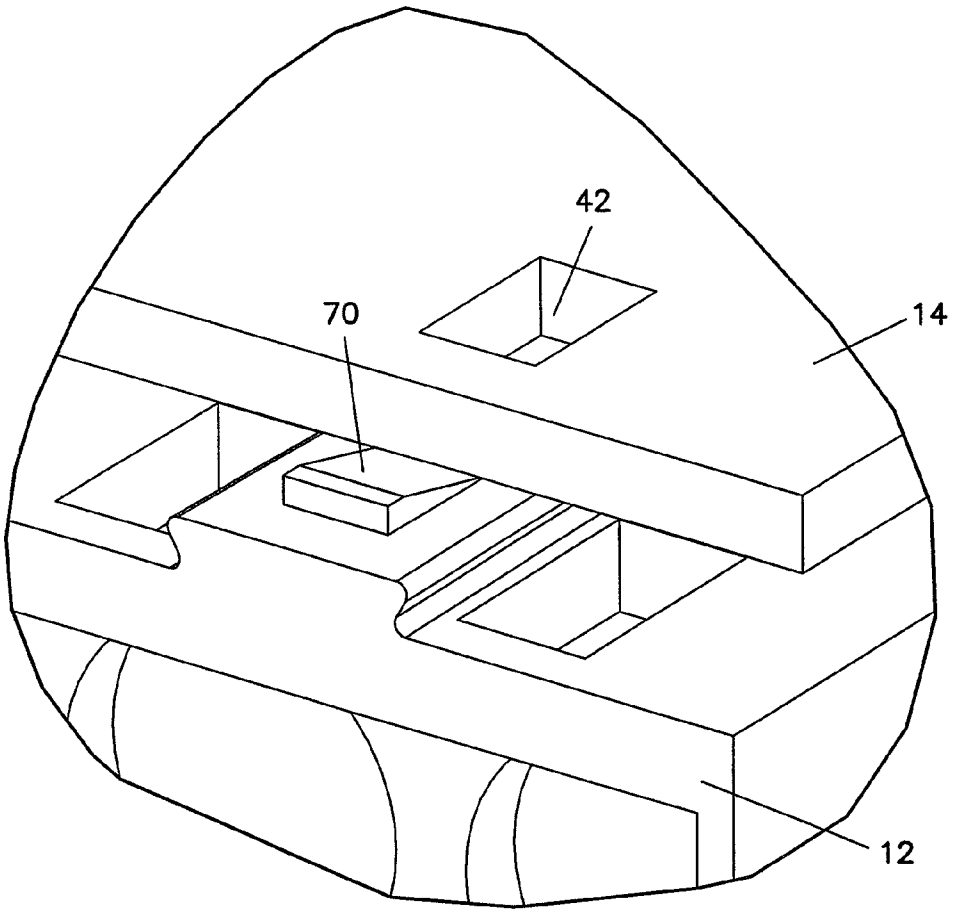
FIG. 2 is a partial close-up view of the interlocking snap-fit structures of the frame and a jack mounting plate.
Figure 3:
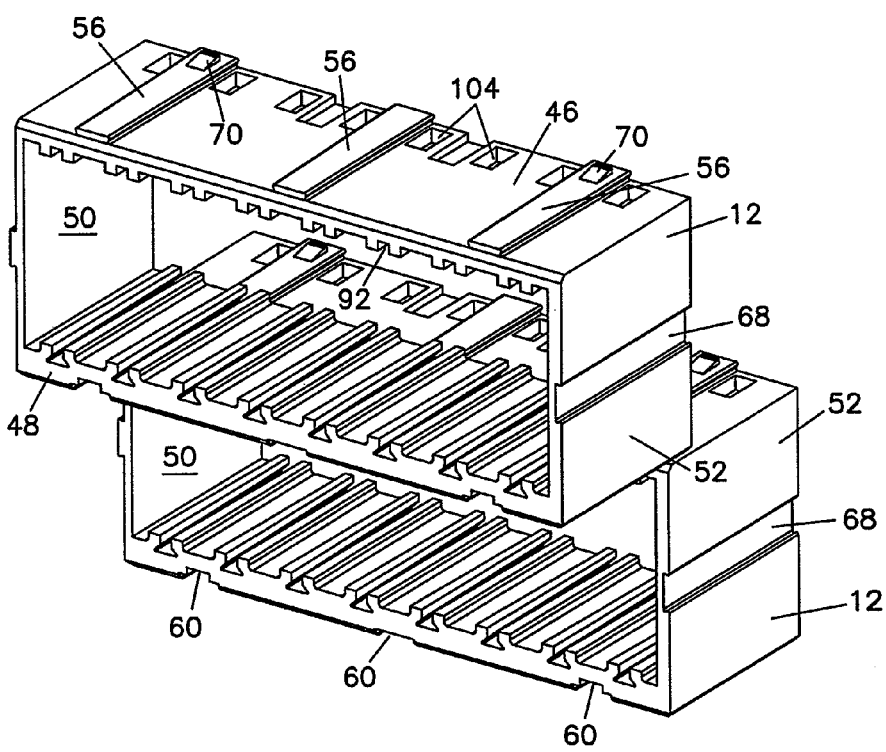
FIG. 3 is a front perspective view of the jack mounting plates of FIG. 1, the jack mounting plates shown being coupled in a vertical arrangement.
Figure 4:
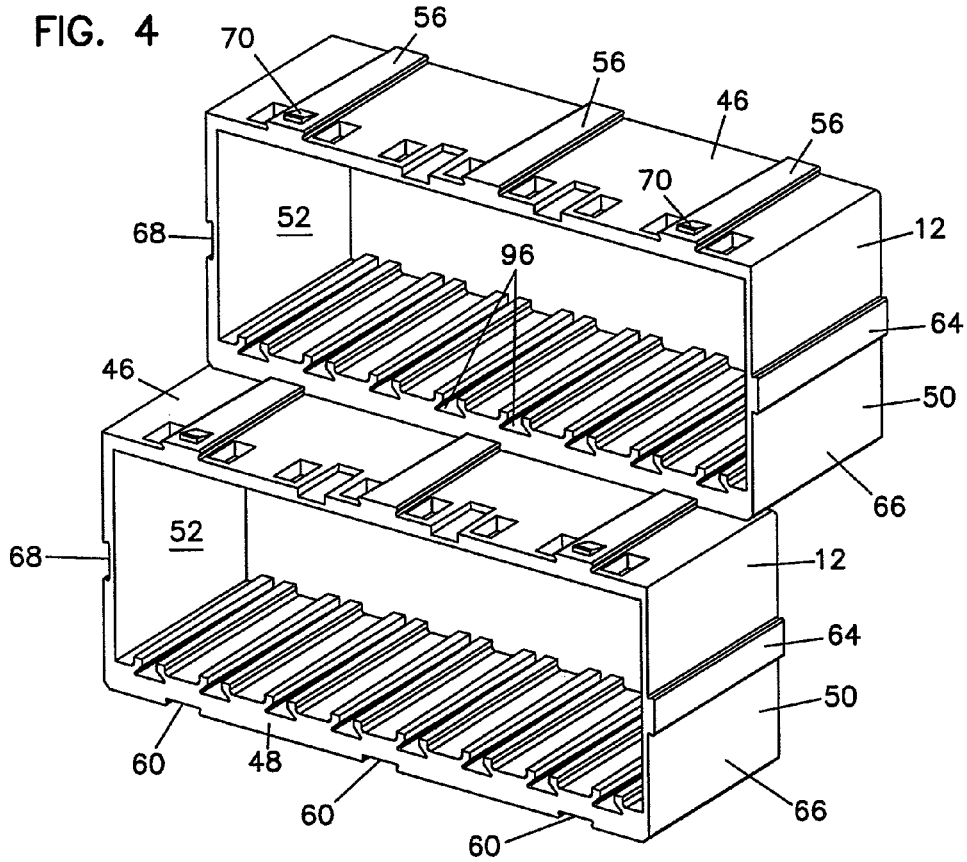
FIG. 4 is a rear perspective view of the jack mounting plates of FIG. 3.
Figure 6:
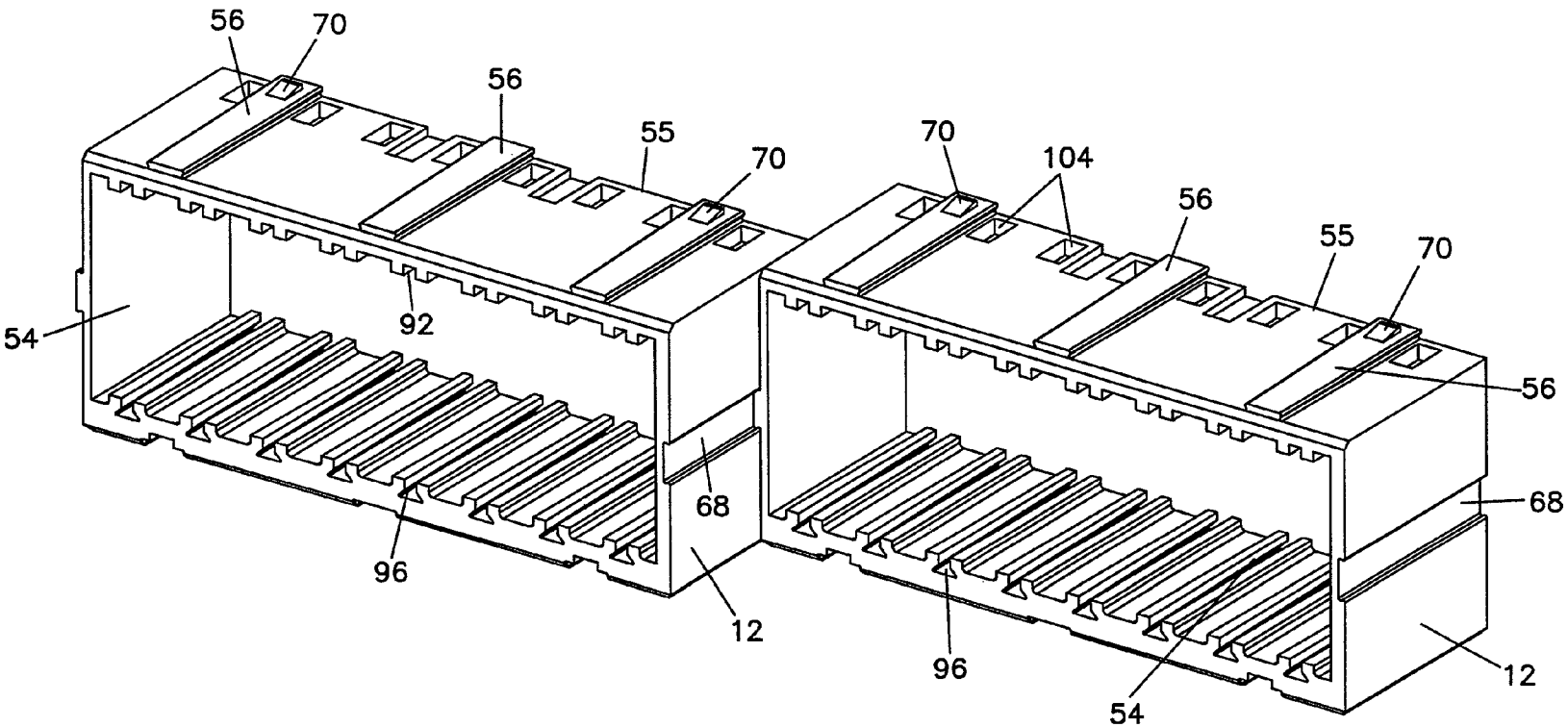
FIG. 6 is a front perspective view of the jack mounting plates of FIG. 5, the jack mounting plates shown being coupled in a horizontal arrangement.

As shown in FIGS. 3 and 4, mounting plates 12 can be assembled in a vertical arrangement. As shown in FIG. 6, mounting plates 12 can be assembled in a horizontal arrangement. Each mounting plate 12 includes a top wall 46, a bottom wall 48, a first sidewall 50, a second sidewall 52, an open front end 54, and an open rear end 55. Mounting plate 12 includes elongate flanges 56 defined on an exterior surface 58 of top wall 46. Each mounting plate 12 also includes elongate grooves 60 defined on an exterior surface 62 of bottom wall 48, which are configured to slidably mate with top flanges 56 of mounting plate 12. Each mounting plate 12 also includes an elongate flange 64 on exterior surface 66 of first sidewall 50 and an elongate groove 68 on exterior surface of second sidewall 52. Side flanges 64 and grooves 68 are configured for slidable mating. In this manner, two mounting plates 12 can be slidably coupled together in a vertical arrangement, as shown in FIGS. 1-4, or in a horizontal arrangement, as shown in FIGS. 5 and 6. Elongate flanges 56, 64 and grooves 60, 68 include cooperating dovetail-shaped profiles such that when two mounting plates 12 are slidably coupled together, they cannot be pulled apart in a direction perpendicular to the sliding direction.

Each mounting plate 12 also includes structure for interlocking mounting plates 12 to frame 14, as discussed previously. As shown in FIGS. 1-8, the two outermost flanges 56 on top wall 46 of each mounting plate 12 include ramped tabs 70 adjacent a rear side 72 of flanges 56. And as shown in FIG. 8, bottom wall 48 of each mounting plate 12 defines a pair of ramped tabs 74 located on the sides of the center groove 60. Top and bottom ramped tabs 70, 74 are configured to couple mounting plates 12 to frame 14 by snap-fitting within openings 42 located at top and bottom walls 18, 20 of frame 14. A close-up view of one of the ramped tabs 70 and one of the openings 42 on frame 14 is illustrated in FIG. 2. Top and bottom ramped tabs 70, 74 of mounting plates 12 and top and bottom openings 42 of frame 14 also align the front openings 26 of frame 14 with cable connection locations 30 of coaxial jacks 28 that are mounted to mounting plates 12.

As shown in FIG. 8, the two outermost elongate grooves 60 defined at bottom wall 48 of mounting plates 12 include a deeper elongate slot 76 within groove 60 for accommodating top ramped tabs 70 of another mounting plate 12 when two mounting plates 12 are vertically coupled. Each mounting plate 12 also includes a shorter slot 78 located on each side of the center top flange 56, as shown in FIGS. 1-7, for accommodating ramped tabs 74 defined at bottom wall 48 of mounting plates 12. Side walls 50, 52 of mounting plates 12 do not include structures for accommodating ramped tabs since side walls 50, 52 of mounting plates 12 do not include snap-fit structures for interlocking with frame 14.

In the depicted embodiment, the deeper elongate slots 76 at bottom wall 48 and the shorter slots 78 at top wall 46 allow a mounting plate 12 to be slidably coupled on top of another mounting plate 12 only in a direction going from the rear end 55 of the bottom mounting plate 12 toward the front end 54 of the bottom mounting plate 12 and be removed in the opposite direction. And, in the depicted embodiment, the mounting plate 12 at the bottom can only be removed from top plate 12 in a direction going from the rear end 55 of the top mounting plate 12 toward the front end 54 of the top plate 12 and be coupled in the opposite direction. Rear ends 80 of the deeper elongate slots 76 act as stops for the bottom mounting plate 12 by abutting against vertical faces 82 of the top ramped tabs 70 when two mounting plates 12 are vertically coupled together. The same directional orientation is followed when vertically coupling together more than two mounting plates 12.

As shown in FIGS. 7 and 8, mounting plates 12 are used for mounting coaxial switching jacks 28 to frame 14. Mounting plates 12 and coaxial switching jacks 28 include intermating and interlocking structures for mounting coaxial jacks 28 to mounting plates 12. As shown in FIGS. 7-10, each coaxial switching jack 28 includes a pair of longitudinal guides 84 extending from front wall 86 of jack 28 towards rear wall 34 of jack 28, one guide 84 located at a top wall 88 of jack 28 and another being located at a bottom wall 90 of jack 28. Top guide 84 of jack 28 includes a generally rectangular profile while guide 84 at bottom wall 90 includes a dovetail profile. Top guides 84 of jacks 28 slide within slots 92 at interior surface 94 of top wall 46 of mounting plates 12. Bottom guides 84 of jacks 28 slide within dovetail shaped slots 96 at interior surface 98 of bottom wall 48 of mounting plates 12.

Each jack 28 also includes a flexible cantilever arm 100 with a ramped tab 102 on top wall 88 for snap fitting jack 28 to a mounting plate 12. Cantilever arm 100 extends from rectangular guide 84 at top wall 88 of jack 28 toward rear wall 34 of jack 28. Ramped tab 102 of flexible cantilever arm 100 snap fits into openings 104 defined at top wall 46 of mounting plate 12.

Rear wall 34 of jack 28 defines a downwardly extending flange 106. Dovetail guide 84 at bottom wall 90 extends from front wall 86 of jack 28 to downwardly extending flange 106. Flange 106 abuts against bottom wall 48 of mounting plate 12 when jack 28 is slidably inserted within a mounting plate 12. Extending farther down from flange 106 is a grip tab 108. Grip tab 108 is formed as a part of the rear wall 34 of jack 28. Grip tab 108 is preferably positioned on jack 28 opposite cantilever arm 100 so that a user may apply opposing forces on cantilever arm 100 and grip 108 tab to securely grasp jack 28 and slidably move it relative to mounting plate 12.

In mounting jacks 28 into mounting plates 12, jacks 28 can be slid forwardly with guides 84 fitting within slots 92, 96. Jacks 28 are slid forwardly until cantilever arms 100 flex down and allow ramped tabs 102 to pass under the top wall 46 of mounting plates 12 and into openings 104. When jacks 28 are desired to be removed from mounting plates 12, opposing forces can be applied to cantilever arms 100 and grip tabs 108 to press down cantilever arms 100. As cantilever arms 100 flex down, ramped tabs 102 clear the top openings 104 of mounting plates 12 and jacks 28 are slid rearwardly.

It should be noted that the depicted alignment structures and interlocking structures between jacks 28 and mounting plates 12, between two mounting plates 12, and between mounting plates 12 and frame 14 are non-limiting examples, other configurations also being possible. For example, in other embodiments, slots 92, 96 located at interior surfaces 94, 98 of top and bottom walls 46, 48 of mounting plates 12 and longitudinal guides 84 of jacks 28 may be interchanged.

Referring now to FIGS. 9-19, coaxial switching jack 28 includes a housing 116 with a cover 118. In certain embodiments, housing 116 defines a non-conductive body 120. Housing 116 defines a front wall 86, a rear wall 34, a top wall 88, a bottom wall 90, and a sidewall 122 located opposite from cover 118.

Jack 28 defines a pair of rear cable connection locations 36 and a pair of front cable connection locations 30. Rear cable connection locations 36 are configured as a pair of rear openings 40 defined in rear wall 34 of housing 116. Front cable connection locations 30 are configured as a pair of front openings 32 in front wall 86 of housing 116. As discussed above, longitudinal guides 84 are located at the top and bottom walls 88, 90 of housing 116 with flexible cantilever arm 100 being located on the top wall 88.

Housing 116 and cover 118 cooperate to define an interior 124. Interior 124 of housing 116 is configured to receive the various components of jack 28. Access into interior 124 may be through rear openings 40 or through front openings 32. The components mounted within interior 124 may be inserted through a side opening 126 in housing 116 which is closed off by cover 118. Cover 118 includes fastener holes 128 for fastening cover 118 to housing 116 with fasteners 130. Cover 118 also includes an opening 132 for accommodating a resistor assembly 134, as will be discussed in further detail below. Cover 118 includes indicia 136 on outer surface 138 for indicating the position of the resistor 140 within housing 116.

At rear wall 34 of housing 116 is included a slot 142 for receiving a designation label panel 144. Designation label panel 144 is slidably inserted within slot 142 and held therein with a friction fit. Slot 142 includes an upper notch 146 to facilitate removal of designation label panel 144 from rear wall 34 of housing 116.

Figure 15:
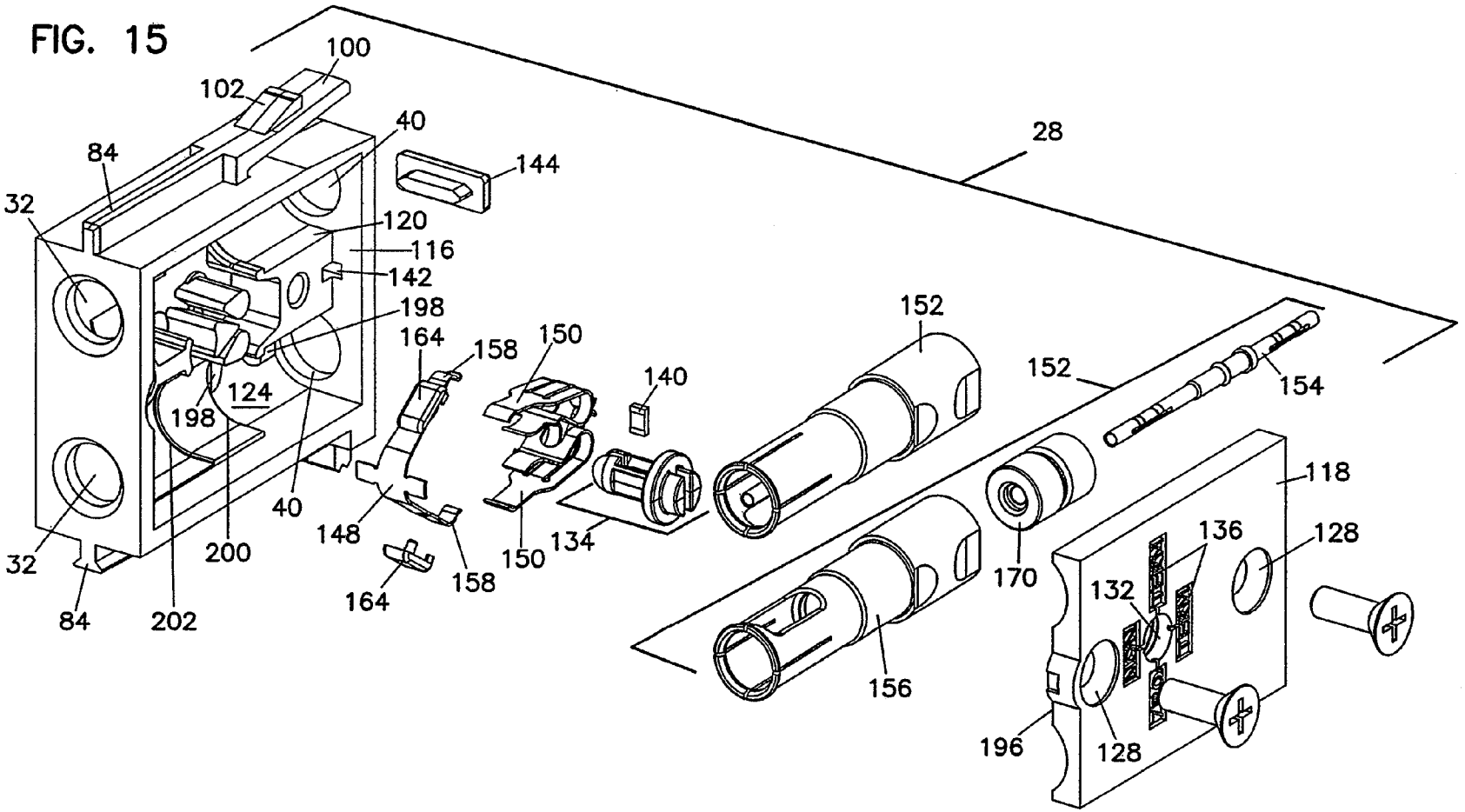
FIG. 15 is an exploded perspective view of the coaxial switching jack of FIG. 9.
Figure 16:
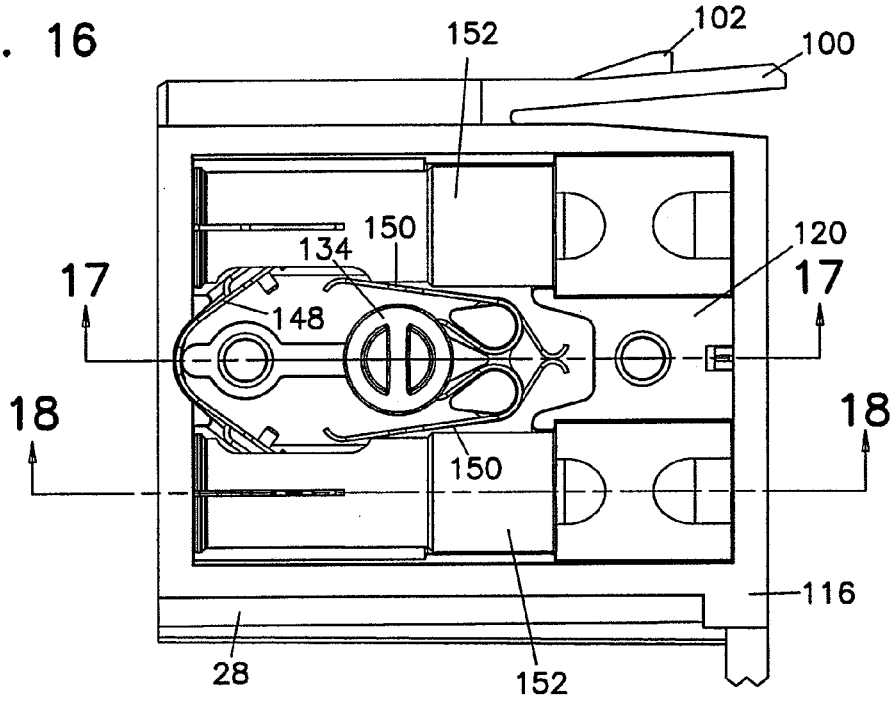
FIG. 16 is a right side elevational view of the coaxial switching jack of FIG. 9 shown with the cover removed.
Figure 17:
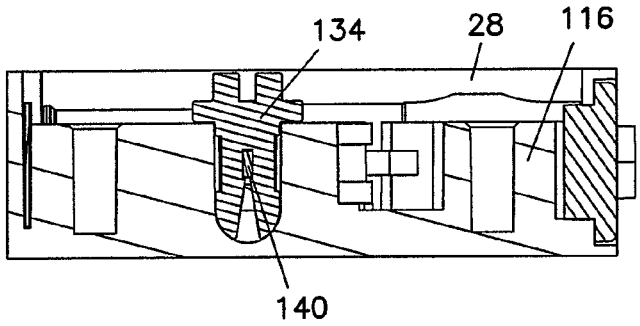
FIG. 17 is a cross-sectional view taken along line 17-17 of FIG. 16.
Figure 18:
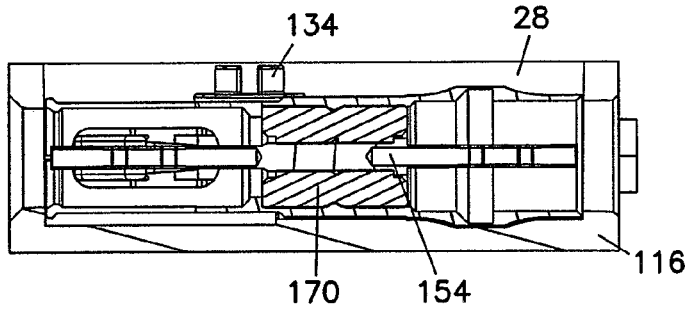
FIG. 18 is a cross-sectional view taken along line 17-17 of FIG. 16.
Figure 19:
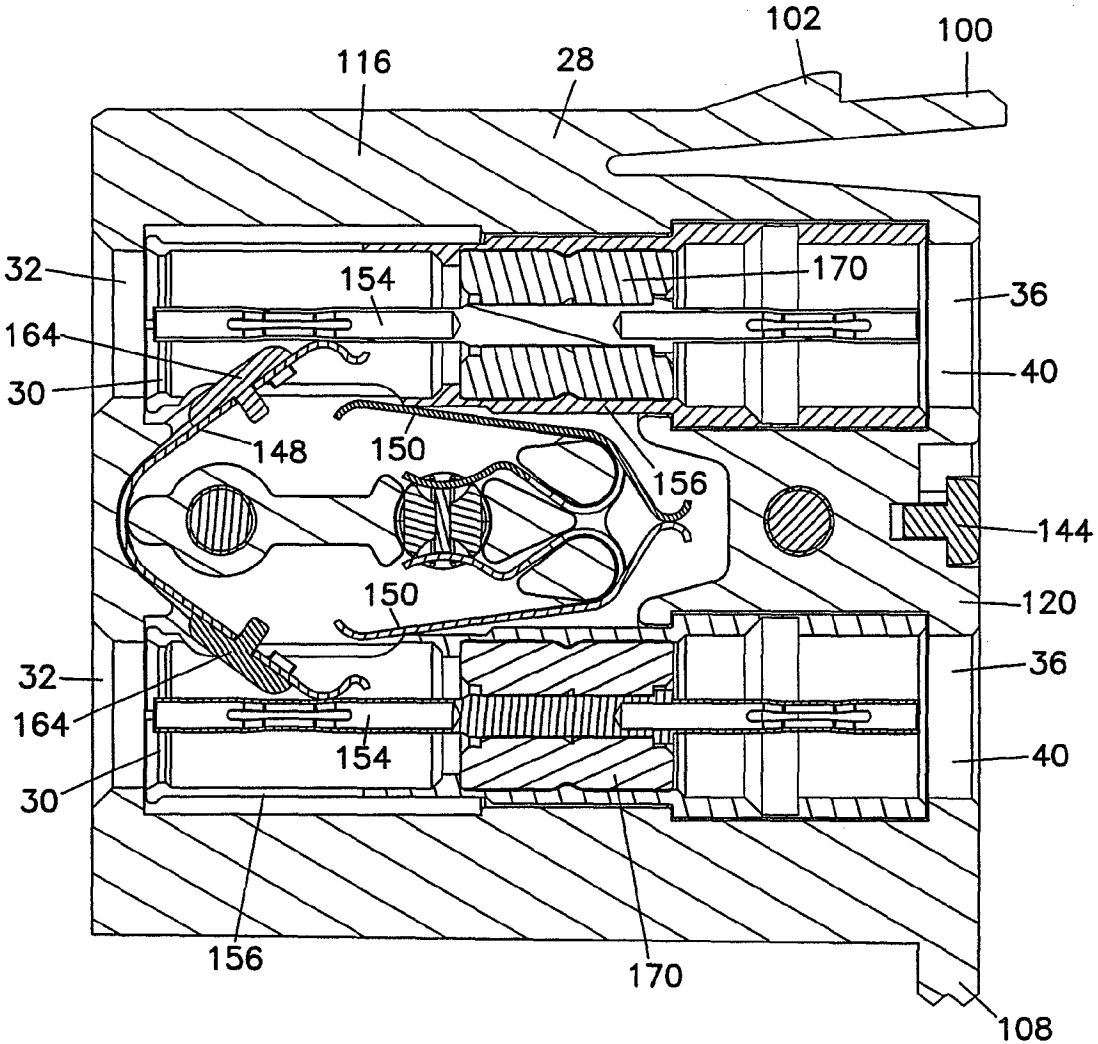
FIG. 19 is a cross-sectional view taken along line 19-19 of FIG. 14.

Referring now to FIGS. 15, 16, and 19, mounted within interior 124 are a center conductor contact spring 148 and a pair of identical shield conductor contact springs 150. Also mounted within interior 124 is a resistor assembly 134 that is located between a pair of coaxial assemblies 152. Each coaxial assembly 152 includes a center conductor 154 and an outer shield conductor 156. Center conductor contact spring 148 is mounted such that arms 158 of center conductor contact spring 148 are normally in contact with of center conductors 154 of coaxial assemblies 152. Shield conductor contact springs 150 are mounted such that they are normally in electrical contact with each other and in electrical contact with shield conductors 156 of coaxial assemblies 152. Springs 148, 150 are preferably made of a resilient electrically conductive material. The non-conductive material of the housing body 120 electrically isolates the outer shield conductors 156 of coaxial assemblies 152.

As shown in FIGS. 16 and 19, center conductor contact spring 148 is positioned within housing 116 between a bulkhead 160 and front wall 86. Arms 158 of spring 148 extend outwardly to be in electrical contact with center conductors 154 of coaxial assemblies 152. Mounted adjacent an outboard end 162 of each arm 158 is an insulator contact pad 164. With no connector 38 inserted through front openings 32, spring 148 normally electrically connects center conductors 154. In a normal or unswitched position, with no connector 38 inserted through front openings 32, pads 164 do not make physical contact with coaxial assemblies 152, as shown in FIG. 19. When a cable connector 38 is inserted through front openings 32, however, contact pads 164 make the initial contact with cable connectors 38 and electrically isolate coaxial assemblies 152 from the rest of the circuit within jack 28, as will be discussed in further detail below.

Still referring to FIGS. 16 and 19, resistor assembly 134 is positioned between the two shield conductor contact springs 150. As will be discussed in further detail, resistor assembly 134 can be switched between an "ON" or "terminated" position 166 and an "OFF" or "non-terminated" position 168. When resistor assembly 134 is turned to an "ON" position 166, resistor 140 provides electrical contact between the shield conductor contact springs 150 to terminate one of the coaxial assemblies 152. Resistor assembly 134 may be turned to an "OFF" position 168 to electrically isolate the two shield conductor contact springs 150 from each other.

Figures 20, 21:
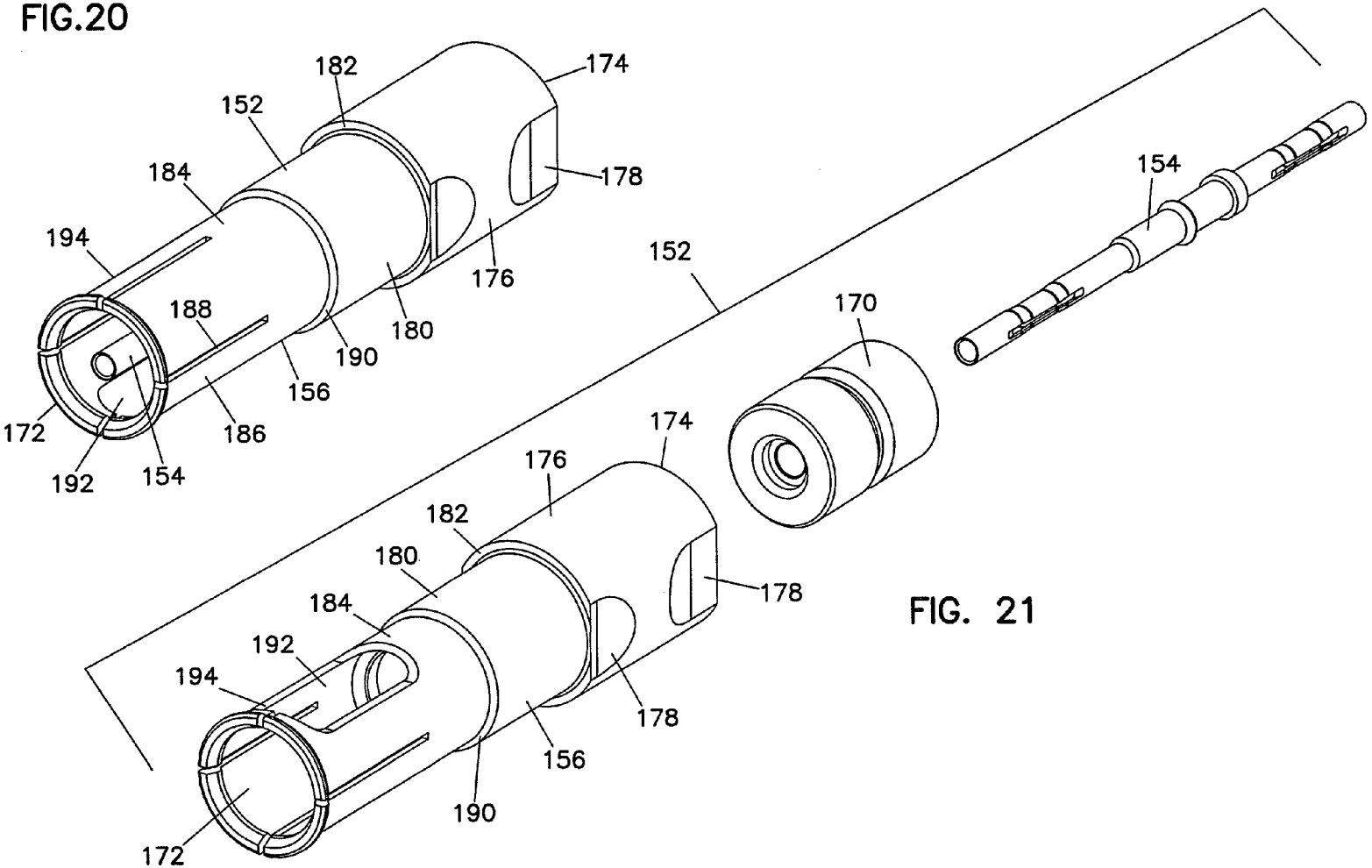
FIG. 20 is a perspective view of the coaxial assembly of the jack of FIG. 15.
FIG. 21 is an exploded perspective view of the coaxial assembly of FIG. 20.

FIGS. 20 and 21 illustrate the coaxial assemblies 152 of jack 28. Each coaxial assembly 152 includes a center conductor 154 electrically isolated from an outer shield conductor 156 by an insulative spacer 170. Spacer 170 positions center conductor 154 coaxially within outer shield conductor 156 and insulates center conductor 154 from outer shield conductor 156. Outer shield conductor 156 defines a front end 172 and a rear end 174 and three different portions extending between front end 172 and rear end 174. First portion 176 is adjacent rear end 174 and includes flats 178. Shield conductor 156 defines an intermediate second portion 180 that has a smaller diameter than first portion 176. First portion 176 and second portion 180 form a generally circular flange 182 thereinbetween. Shield conductor 156 defines a third portion 184 adjacent front end 172. Third portion 184 is a cable connector receiving portion and includes longitudinally extending legs 186 with slots 188 defined thereinbetween, legs 186 configured to flex radially to accept a cable connector 38. Third portion 184 includes a smaller diameter than intermediate portion 180 and defines a generally circular flange 190 therewith intermediate portion 180. Third portion 184 of outer shield conductor 156 defines an opening 192 on its perimeter 194. Openings 192 generally face inwardly toward the center of interior 124 of housing 116 when coaxial assemblies 152 are seated into housing 116. Openings 192 allow arms 158 of center conductor contact spring 148 to extend into coaxial assemblies 152 to make electrical contact with center conductors 154, as shown in FIG. 19.

As shown in FIG. 15, inner surface 196 of cover 118 includes a shape that is complementary to the shape of shield conductors 156. Likewise, interior 124 of housing 116 includes a shape that is complementary to the shape of shield conductors 156. Housing 116 and cover 118 include flats 198 that are complementary to flats 178 defined on first portion 176 of shield conductor 156. Flats 198 of housing 116 and cover 118 and flats 178 of shield conductors 156 prevent radial turning of shield conductors 156 within housing 116 once they are seated. This provides for proper alignment of openings 192 relative to arms 158 of center conductor contact spring 148. Housing 116 and cover 118 also include shoulders 200, 202 that abut against flanges 182, 190, respectively, to prevent longitudinal movement of the coaxial assemblies 152 within housing 116. It should be understood that the depicted embodiment of the coaxial assembly is a non-limiting example and that the coaxial assemblies and the interior shapes of housing 116 and cover 118 can include various other configurations within the spirit of the invention.

Figure 23:
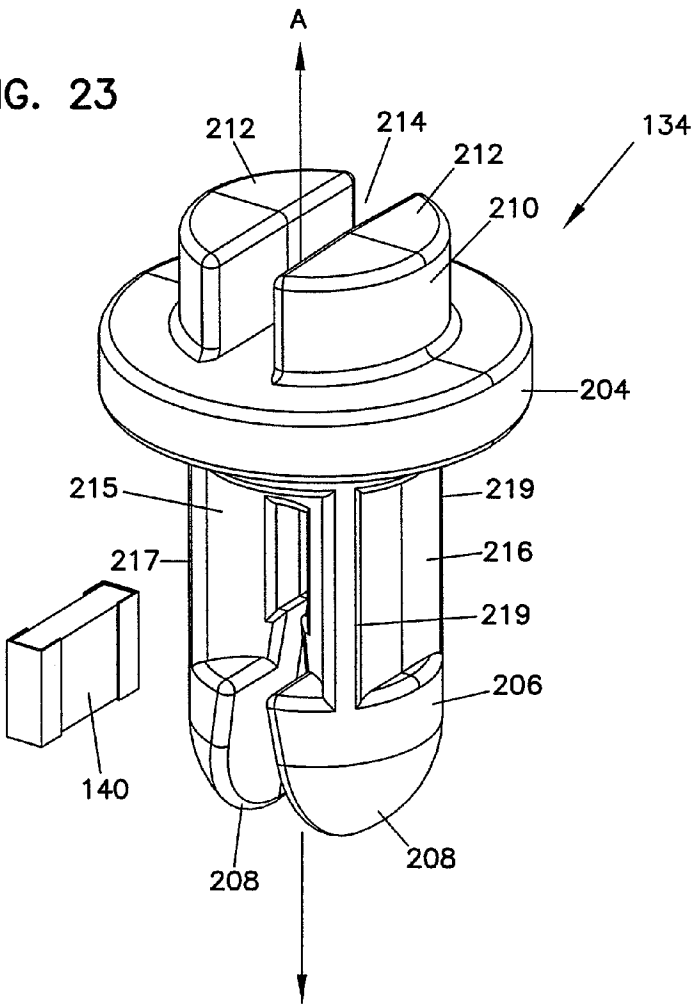
FIG. 23 is an exploded perspective view of the resistor assembly of FIG. 22.
Figure 22:
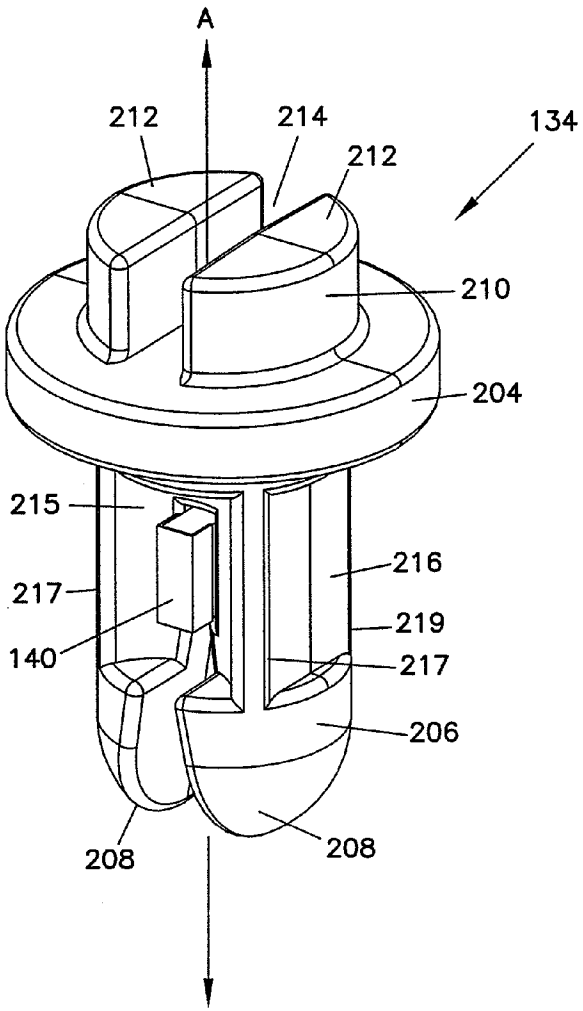
FIG. 22 is a perspective view of the resistor assembly for use with the jack of FIG. 15.

FIGS. 22 and 23 illustrate the resistor assembly 134 of the present invention. Resistor assembly 134 includes a resistor 140 housed within an insulative resistor housing 204. Resistor housing 204 includes a bottom portion 206 with a pair of flexible legs 208 for receiving and holding resistor 140 thereinbetween. Resistor housing 204 includes a top portion 210 including two flanges 212 defining a slot 214 thereinbetween. Once inserted within jack housing 116, resistor housing 204 is turnable about its longitudinal axis A. Slot 214 defined between flanges 212 at top portion 210 of resistor housing 204 can be used to rotate resistor housing 204. In the depicted embodiment, resistor housing 204 is rotatable to provide either a 75 ohm resistance between the shield conductor contact springs 150 or to electrically isolate the shield conductor contact springs 150 from each other. In other embodiments, resistors having other resistance values can be used. Resistor 140 is removable from resistor housing 204 and replaceable by another one if needed. Resistor 140 can be removed from jack 28 and replaced by first removing resistor housing 204.

Bottom portion 206 of resistor housing 204 includes a first set of recesses 216 and a second set of recesses 215. The recesses 215, 216 are located at generally ninety degree intervals around the perimeter of bottom portion 206 of housing 204. Recesses 216 are defined as a part of flexible legs 208. Recesses 215 include portions that are both a part of flexible legs 208 and portions that are defined between flexible legs 208. Recesses 215 and 216 are configured to accommodate the curvature of the shield conductor contact springs 150 (see FIG. 19) when resistor housing 204 is turned to an "ON" position 166 or to an "OFF" position 168. Shield conductor contact springs 150 apply spring tension to edges 217 and 219 of recesses 215 and 216, respectively and edges 217 and 219 of recesses 215 and 216, respectively abut against shield conductor contact springs 150 to keep resistor 140 at an "ON" position 166 or an "OFF" position 168 when resistor 140 is turned to one of these positions.

Figure 24:
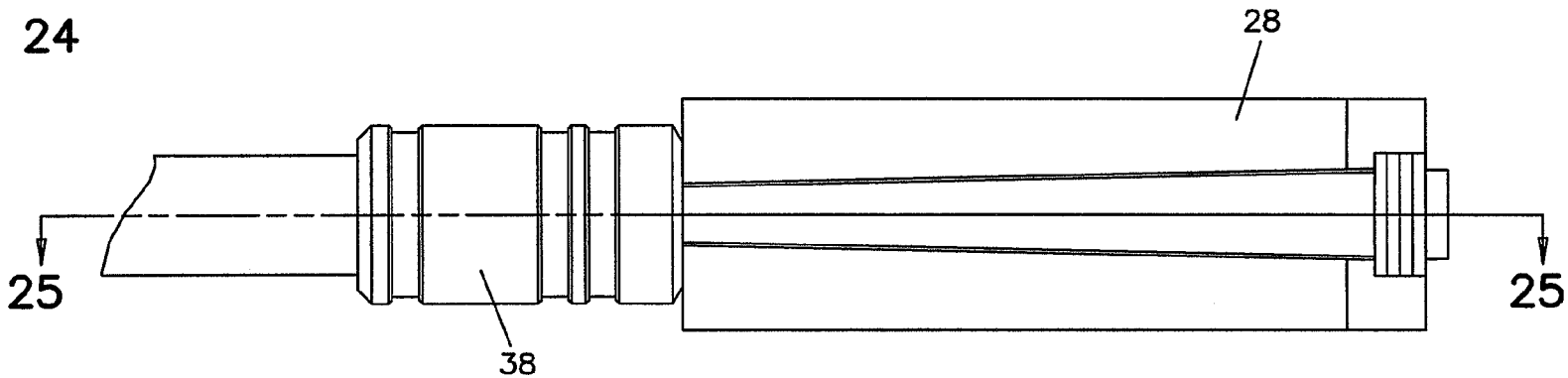
FIG. 24 is a bottom plan view of the coaxial switching jack of FIG. 9 shown with a coaxial cable connector coupled thereto.
Figure 25:
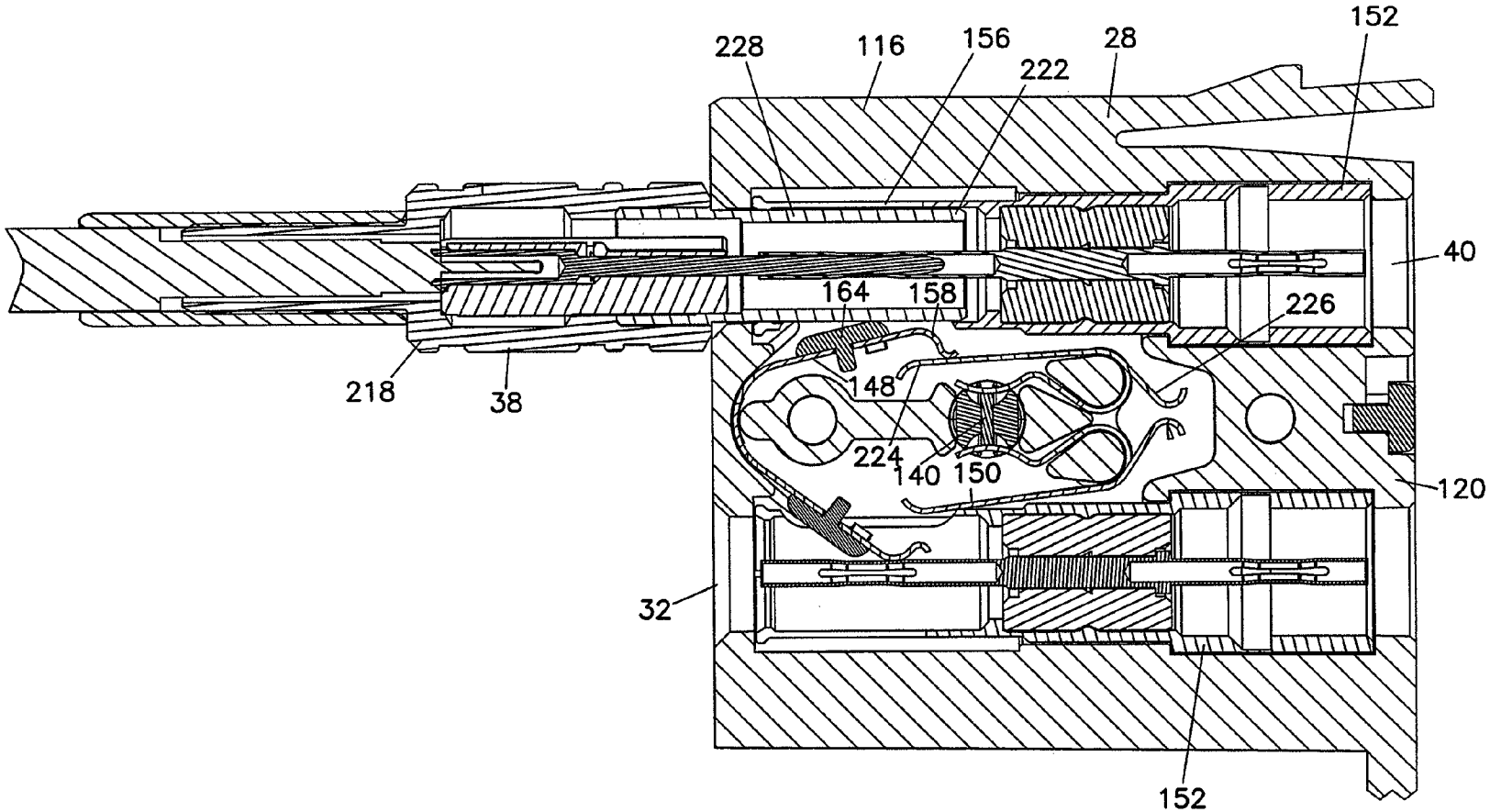
FIG. 25 is a cross-sectional view taken along line 25-25 of FIG. 24.

FIGS. 24 and 25 illustrate jack 28 with a cable connector 38 inserted in one of the front openings 32. In this arrangement, outer conductor 218 of cable connector 38 is electrically connected to outer shield 156 and center conductor 220 of cable connector 38 is electrically connected to center conductor 154 of coaxial assembly 152. When a connector 38 is inserted within opening 32, front end 222 of connector 38 makes initial contact with insulative pad 164 of center conductor contact spring arm 158. Without making electrical contact with spring 148, front end 222 deflects arm 158 away from contact with center conductor 154. This breaks the electrical linkage between center conductors 154 of coaxial assemblies 152. Pad 164 insulates outer conductor 218 of connector 38 from electrical contact with spring 148.

As shown in FIG. 25, after arm 158 is moved away from contact with center conductor 154, arm 158 pushes on a first end 224 of shield conductor contact spring 150, flexing an opposite second end 226 away from the other shield conductor contact spring 150 breaking direct electrical contact between the two outer shield conductor contact springs 150. In this manner, the coaxial assembly 152 to which a cable connector 38 is coupled becomes completely electrically isolated from the other coaxial assembly 152 within jack 28. With the movement of springs 148, 150, center conductor 154 of the other coaxial assembly 152 becomes electrically connected to outer shield 156 of the other coaxial assembly 152 through resistor 140.

When a cable connector 38 is inserted within front opening 32, outer conductor 218 of connector 38 closes opening 192 on perimeter 194 of outer shield conductor 156 of coaxial assembly 152. In this manner, outer shield conductors 218, 156 of connector 38 and the corresponding coaxial assembly 152 cooperatively form a generally cylindrical conductive passage 228 about center conductor 220, 154 of connector 38 and the corresponding coaxial assembly 152. Cylindrical passage 228 extends from front openings 32 to rear openings 40.

Figure 27:
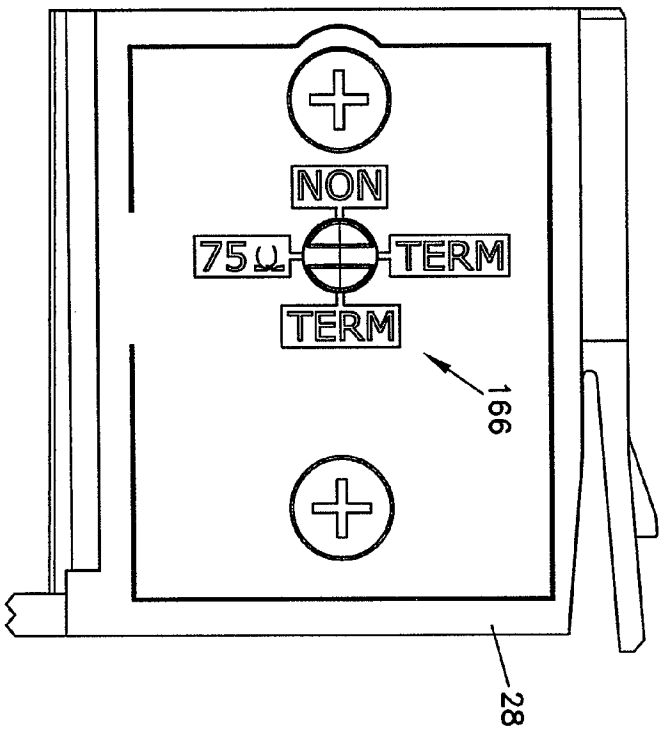
FIG. 27 is a right side elevational view of the coaxial switching jack of FIG. 9, the resistor of the coaxial switching jack shown in a terminated position.

Thus, when one connector 38 is inserted within one coaxial assembly 152 through one of the openings 32, as shown in FIGS. 24 and 25, the other coaxial assembly 152 remains in electrical contact with springs 148 and 150. Through resistor 140, springs 148 and 150 now electrically connect center and shield conductors 154, 156 of the other coaxial assembly 152. In some instances, it is desirable to have some level of impedance, such as 75 ohms, between center and shield conductors 154, 156. In these instances, the resistor 140 may be provided at the "ON" or "terminated" position 166 as shown in FIG. 27. Other levels of impedance may also be provided by replacing resistor 140 with other resistors within resistor housing 204.

Figure 28:
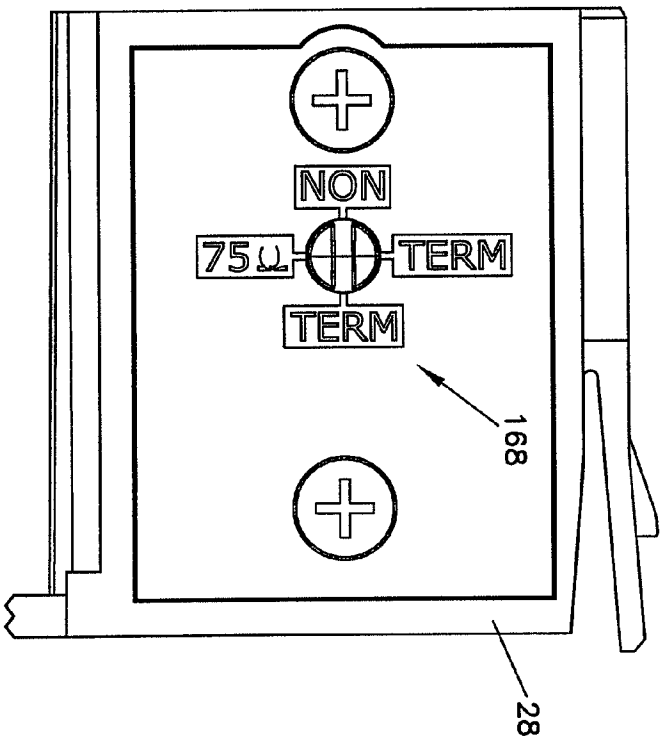
FIG. 28 is a right side elevational view of the coaxial switching jack of FIG. 9, the resistor of the coaxial switching jack shown in a non-terminated position.

In other instances, it may be desirable to electrically isolate center conductor 154 from outer shield conductor 156 of the unconnected coaxial assembly 152. In these instances, resistor assembly 134 can be turned or rotated to the "OFF" or "non-terminated" position 168 as shown in FIG. 28. In this position, insulative flanges 212 located at top portion 210 of resistor housing 204 electrically isolate the two shield conductor contact springs 150 from each other.

Figure 26:
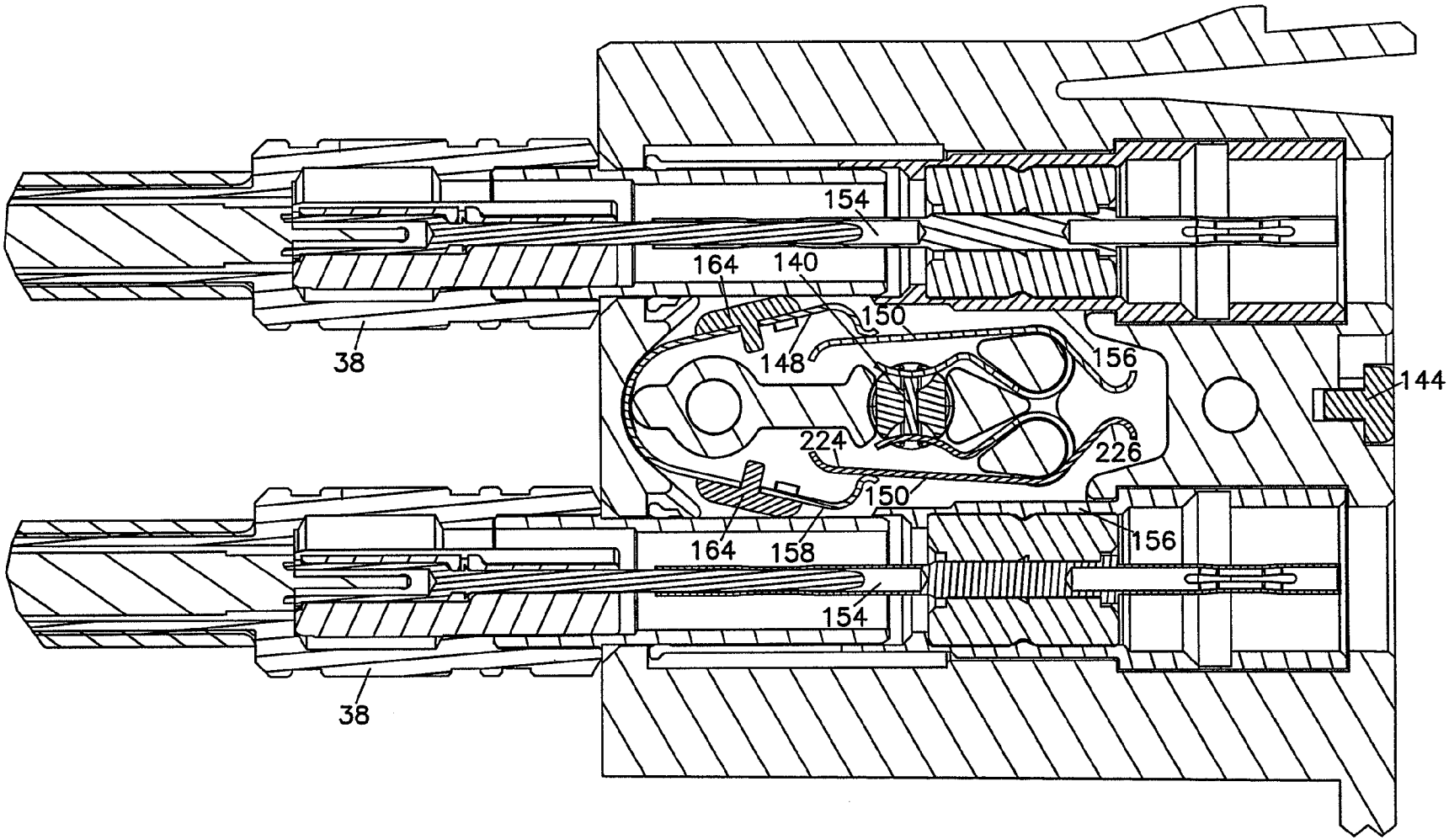
FIG. 26 is a cross-sectional view taken along a line similar to line 25-25 of FIG. 24, illustrating two coaxial cable connectors coupled to the coaxial switching jack.

When a second cable connector 38 is inserted into the other front opening 32 as shown in FIG. 26, front end 222 of the second connector 38 deflects arm 158 away from center conductor 154. Arm 158 pushes on a first end 224 of shield conductor contact spring 150 to flex second end 226 away from direct electrical contact with the other shield conductor contact spring 150. Thus, in this manner, when two cable connectors 38 are inserted into front openings 32 of coaxial jack 28, center conductor contact spring 148 and shield conductor contact springs 150 become oriented such that the two coaxial assemblies 152 are electrically isolated from each other.

FIGS. 29-32 illustrate an alternative embodiment of a coaxial jack 300 according to the invention. Jack 300 is similar in structure to jack 28 of FIGS. 9-19. Jack 300 is configured, however, as a straight-through, non-switching jack. Accordingly, in this embodiment, jack housing 302 does not include springs 148 and 150 discussed above. As in the switching jack embodiment 28, when a connector 38 is inserted within a front opening 304, outer shield conductor 218 of connector 38 and an outer shield conductor 306 of the corresponding coaxial assembly 308 cooperatively form a generally cylindrical conductive passage 310 about center conductors 220 of connector 38 and a center conductor 312 of the corresponding coaxial assembly 308.

Figure 29:
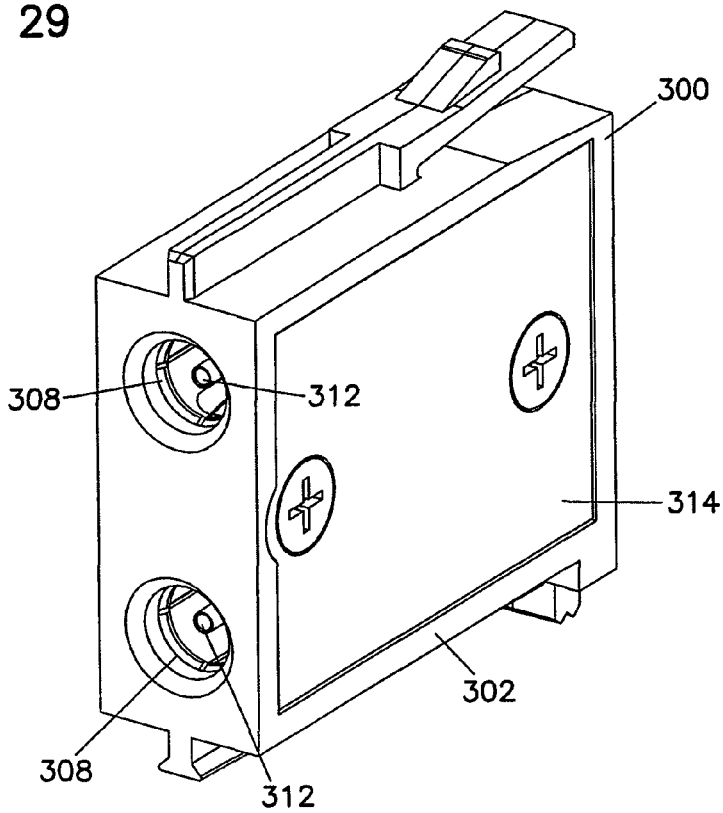
FIG. 29 is a front perspective view of an alternative coaxial jack according to the present invention.
Figure 32:
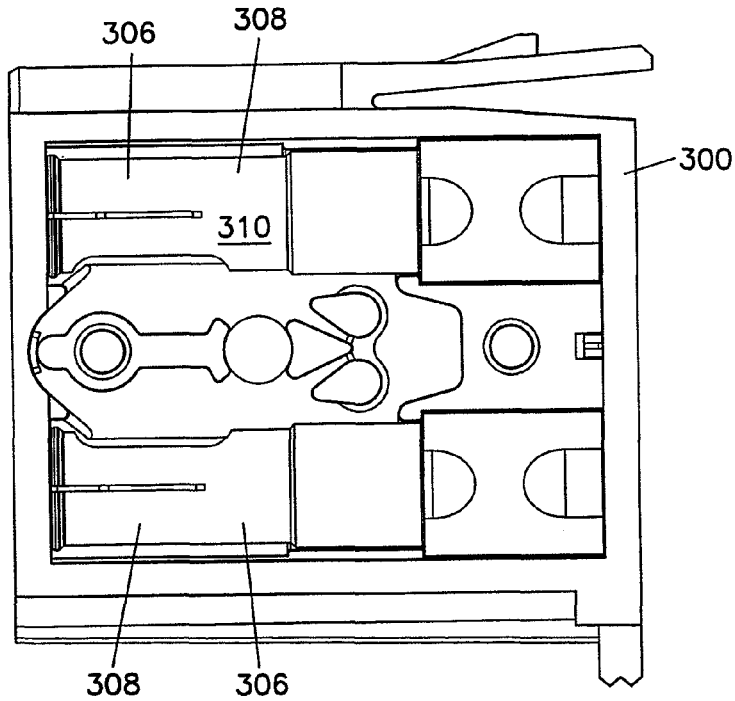
FIG. 32 is a right side elevational view of the coaxial jack of FIG. 29 shown with the cover removed.
Figure 31:
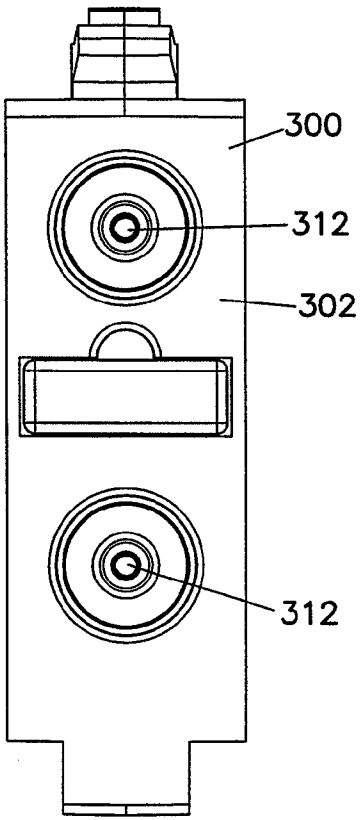
FIG. 31 is a rear elevational view of the coaxial jack of FIG. 29.
Figure 30:
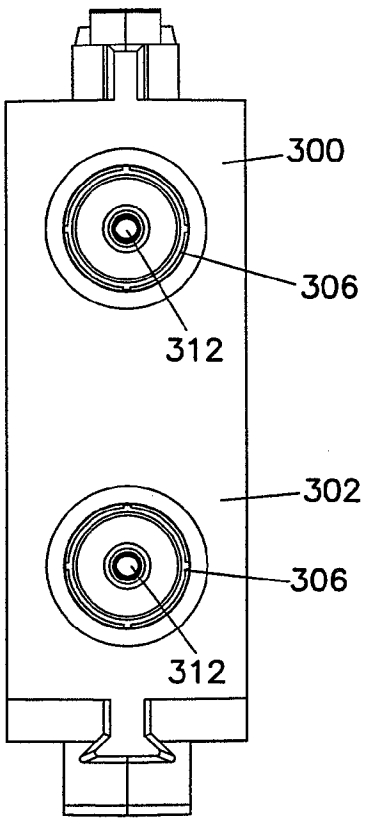
FIG. 30 is a front elevational view of the coaxial jack of FIG. 29.

Coaxial jack 300 of FIGS. 29-32 does not include a resistor assembly 134. In FIG. 29, jack housing 302 is shown with cover 314 mounted thereon. As illustrated, cover 314 does not include any structure for accommodating a rotatable resistor assembly 134 as in the first embodiment of coaxial jack 28.

It should be noted that, although the housing 116 of the switching type coaxial jack 28 has been described as including a non-conductive body 120, certain portions of the housing 116 can include conductive materials. For example, in certain embodiments, parts of housing 116 may include conductive materials for tuning purposes. By providing a certain amount of conductive material within interior 124 of housing 116 or around the exterior of housing 116, the impedance level between center conductor 154 and outer shield conductor 156 can be adjusted and tuned to a desired value.

In other embodiments, certain portions of the housing, whether the jack is a switching jack 28 or a straight-through jack 300, may include conductive material for shielding purposes to prevent crosstalk between adjacent jacks. For example, in certain embodiments, the shielding conductive portions can be included on the cover and/or on opposite sidewall of a jack. In other embodiments, the shielding portions can be included on other parts of the housing.

The above specification, examples and data provide a complete description of the manufacture and use of the invention. Since many embodiments of the invention can be made without departing from the spirit and scope of the invention, the invention resides in the claims hereinafter appended.

What is claimed is:

1. A coaxial switching jack comprising:

a housing defining an interior and an exterior, the housing including a pair of front cable connection locations and a pair of rear cable connection locations, each front cable connecting location configured to receive a mating coaxial cable connector;

a pair of coaxial assemblies mounted within the interior of the housing, each coaxial assembly having a first end adjacent one of the front cable connection locations and a second end adjacent one of the rear cable connection locations, each coaxial assembly including a center conductor and an outer shell conductor, the outer shell conductor of each coaxial assembly including a generally cylindrical wall and an opening formed in the cylindrical wall, wherein the center conductors of the coaxial assemblies are electrically connected to each other by conductive elements extending through the openings in the cylindrical walls of the outer shell conductors and the outer shell conductors of the coaxial assemblies are also electrically connected to each other;

a resistor assembly mounted within the interior of the housing, the resistance level of the resistor assembly being changeable from the exterior of the housing;

wherein insertion of the mating coaxial cable connector into one of the front cable connection locations electrically isolates the center conductors of the coaxial assemblies from each other and also electrically isolates the outer shell conductors of the coaxial assemblies from each other;

wherein insertion of the mating coaxial cable connector into one of the front cable connection locations electrically connects a center conductor of the mating coaxial cable connector with the center conductor of the corresponding coaxial assembly and electrically connects an outer shell conductor of the mating coaxial cable connector with the outer shell conductor of the corresponding coaxial assembly;

wherein once the mating coaxial cable connector is inserted into one of the front cable connection locations, the outer shell conductor of the mating coaxial cable connector closes the opening on the cylindrical wall of the outer shell conductor of the corresponding coaxial assembly to form a generally cylindrical conductive passage about the center conductors of the mating coaxial cable connector and of the corresponding coaxial assembly, the cylindrical passage extending from the first end of the corresponding coaxial assembly to the second end of the corresponding coaxial assembly; and wherein once the mating coaxial cable connector is inserted into one of the front cable connection locations to engage the corresponding coaxial assembly, the center conductor of the non-mated coaxial assembly is electrically connected to the outer shell conductor of the non-mated coaxial assembly through the resistor assembly, wherein the impedance level between the center conductor and the outer shell conductor of the non-mated coaxial assembly can be changed through the resistor assembly from the exterior of the housing.

2. A coaxial switching jack according to claim 1, wherein the housing includes non-conductive portions for electrically isolating the outer shell conductors of the pair of coaxial assemblies.

3. A coaxial switching jack according to claim 1, wherein the conductive elements electrically connecting the center conductors of the coaxial assemblies through the openings in the cylindrical walls of the outer shell conductors include springs deflectable by the mating coaxial cable connector.

4. A coaxial switching jack according to claim 1, wherein the impedance level between the center conductor and the outer shell conductor of the non-mated coaxial assembly is changeable from 0 ohms to a positive value.

5. A coaxial switching jack according to claim 4, wherein the impedance level between the center conductor and the outer shell conductor of the non-mated coaxial assembly is changeable from 0 ohms to about 75 ohms.

6. A coaxial switching jack according to claim 1, further comprising the mating coaxial cable connector inserted into one of the front cable connection locations.

7. A coaxial switching jack according to claim 6, further comprising a second mating coaxial cable connector inserted into the other of the front cable connection locations.

8. A coaxial switching jack according to claim 1, wherein the resistor assembly includes a resistor that is moveably mounted within the housing, the resistor moveable between an electrical contact "ON" position and an electrical isolation "OFF" position without being removed from the housing.

9. A coaxial switching jack according to claim 1, wherein the housing includes an open side and a cover positioned to cover the open side, the cover and the housing cooperating to define the interior, the resistance level of the resistor assembly being changeable from the exterior of the housing without removing the cover from the housing.

10. A coaxial switching jack according to claim 1, wherein the housing includes snap-fit interlock structures for snap-fitting the housing to a piece of telecommunications equipment.

* * * * *